United States Patent [19]

Lowther

[11] 4,215,659

[45] Aug. 5, 1980

[54] INTERNAL COMBUSTION ENGINE

[75] Inventor: Frank E. Lowther, Buffalo, N.Y.

[73] Assignee: Purification Sciences Inc., Geneva, N.Y.

[21] Appl. No.: 961,264

[22] Filed: Nov. 16, 1978

Related U.S. Application Data

[63] Continuation-in-part of Ser. No. 955,896, Oct. 30, 1978, Ser. No. 955,895, Oct. 30, 1978, and Ser. No. 947,998, Oct. 2, 1978.

[51] Int. Cl.[2] ..... P02B 33/00

[52] U.S. Cl. ..... 123/68; 123/39

[58] Field of Search ..... 123/68, 39

[56] References Cited

U.S. PATENT DOCUMENTS

| | | | |
|---|---|---|---|
| 388,372 | 8/1888 | Otto | 123/68 |
| 657,392 | 9/1900 | Burger | 123/68 |
| 688,907 | 12/1901 | Wallmann | 123/68 |
| 1,597,924 | 8/1926 | Powell | 123/68 |

*Primary Examiner*—Wendell E. Burns

[57] ABSTRACT

An internal combustion engine of the gasoline or diesel reciprocating piston type wherein the fuel and air are fed into the combustion chamber in the sequence: (1) fuel is fed into the combustion chamber first, and (2) air (preferably compressed air) is then fed into the combustion chamber. This sequence provides both physical and chemical combustion process advantages and can be used in either gasoline or diesel engines of either the 2-stroke or 4-stroke type as well as in applicant's modified 2-stroke type engine.

63 Claims, 12 Drawing Figures

INTERNAL COMBUSTION ENGINE

CROSS-REFERENCE TO RELATED APPLICATIONS

This application is a continuation-in-part of applicant's copending applications: (1 ) Ser. No. 955,896, filed Oct. 30, 1978, entitled INTERNAL COMBUSTION ENGINE; (2) Ser. No. 955,895, filed Oct. 30, 1978, entitled TWO-STROKE INTERNAL COMBUSTION ENGINE; and (3) Ser. No. 947,998, filed Oct. 2, 1978, entitled HYBRID ENGINE.

BACKGROUND OF THE INVENTION

1. Field of the Invention

This invention relates to internal combustion engines and in particular to both diesel and gasoline internal combustion engines of the reciprocating piston type.

2. Description of the Prior Art

The conventional diesel and gasoline internal combustion engines of the reciprocating piston type feed air and fuel into the combustion chambers either one of two ways: (1) simultaneously (the gasoline engine), or (2) sequentially with the sequence being first the air and then the fuel (the diesel engine). In both types, the air is compressed in the combustion chamber by the next stroke of the piston (i.e. in its movement from bottom dead center (B.D.C.) to stop dead center (T.D.C.)).

BRIEF SUMMARY OF THE INVENTION

An internal combustion engine method and apparatus wherein the air and fuel are sequentially fed into the combustion chamber with the sequence being first the fuel and then the air. The air is preferably fed in as compressed air and preferably when the piston is adjacent T.D.C. (or at least closer to T.D.C. than to B.D.C.). This sequence provides both physical and chemical advantages in the combustion process. The present invention can be used in 4-stroke, 2-stroke and in applicant's modified 2-stroke engines.

It is an object of this invention to improve the performance of an internal combustion engine by feeding the fuel into the combustion chamber first and then feeding in the air.

It is another object of this invention to provide a fast, compressed air injection internal combustion engine, this air injection to follow after the fuel has been injected or fed into the combustion chamber.

Applicant's previously filed copending patent applications listed below are hereby incorporated by reference in their entirety in this application: (1) Ser. No. 955,896, filed Oct. 30, 1978, entitled INTERNAL COMBUSTION ENGINE; (2) Ser. No. 955,895, filed Oct. 30, 1978, entitled TWO-STROKE INTERNAL COMBUSTION ENGINE: and (3) Ser. No. 947,998, filed Oct. 2, 1978, entitled HYBRID ENGINE.

BRIEF DESCRIPTION OF THE DRAWINGS

The present invention will be more fully understood by reference to the following detailed description thereof, when read in conjunction with the attached drawings, wherein like reference numerals refer to like elements and wherein.

DETAILED DESCRIPTION OF THE INVENTION

Otto and diesel cycles are non-flow processes in that no air is added during the compression and power strokes. A Brayton cycle is a flow process in that air is constantly entering the compressor and expander (turbine). The thermodynamic relations for non-flow and flow processes are entirely different. The present invention appears to reside somewhere inbetween the known non-flow and flow processes. Pistons and valves are present as are normally associated with Otto and diesel cycle engines. However, the inlet valves can be open for significant portions of the compression and expansion strokes (for example, when the compression is done outside of a four stroke engine there is no need for a compression stroke so that the inlet valve can stay open the entire time of the intake and compression strokes for a 1:1 compression ratio). The concept of this invention appears to approach a Brayton cycle engine with reciprocating pistons, from one viewpoint. From another, the concept would appear to approach a diesel or an Otto cycle engine with flow during compression and expansion. It is to be noted that a diesel and the Otto cycles are each non-flow cycles when considering the period during compression and expansion in the cylinder, while they are, flow processes when considered as engines with continuous (pulsating) inlets and exhausts.

Applicant has determined that valves can be opened and closed fast enough to make the modified cycles of this invention practical. These modified cycles are hereafter referred to as the "fast compressed air injection cycles".

Figure 1:
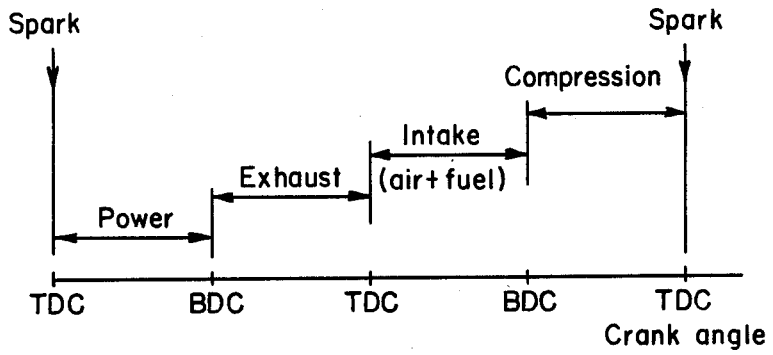
FIG. 1 (PRIOR ART)
FIG. 1 is a chart showing the operation of a standard 4-stroke Otto engine.
Figure 2:
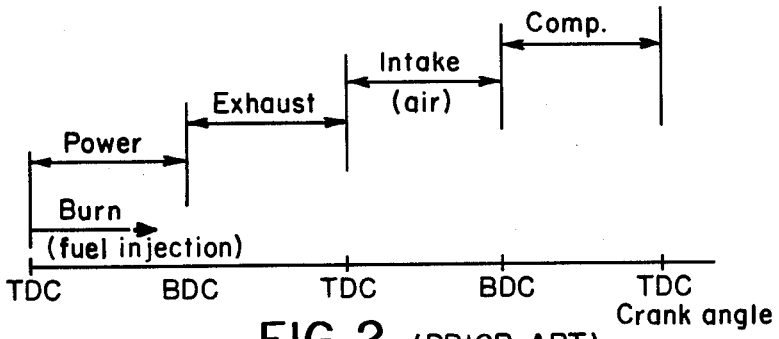
FIG. 2 (PRIOR ART)
FIG. 2 is a chart showing the operation of a standard 4-stroke diesel engine.
Figure 3:
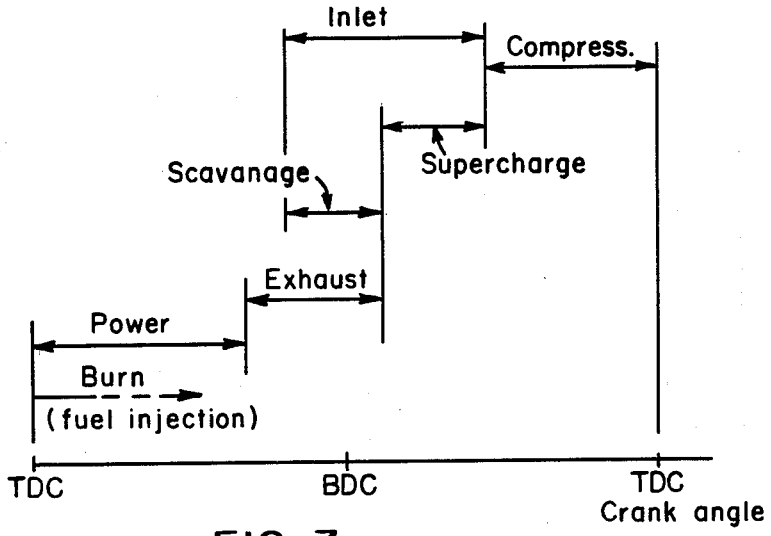
FIG. 3 (PRIOR ART)
FIG. 3 is a chart showing the operation of a standard 2-stroke diesel engine.

Referring now to the drawings, FIG. 1, 2, and 3 are charts which illustrate the operation of a 4 stroke Otto engine, a 4 stroke diesel engine, and a2 stroke diesel engine respectively. There is one point in common with all of these classic cycles: the air is either admitted to the engine combustion chamber before or during the period of fuel injection.

Figure 4:
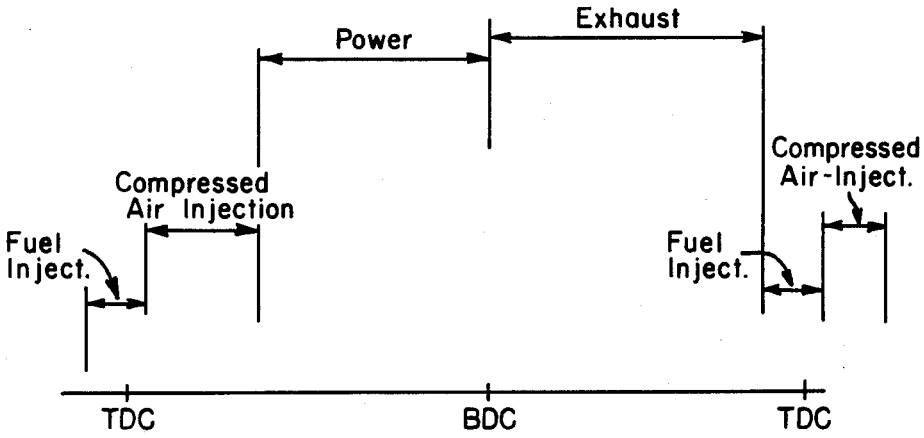
FIG. 4 is a chart showing the operation of a 2-stroke engine of the present invention.
Figure 5:
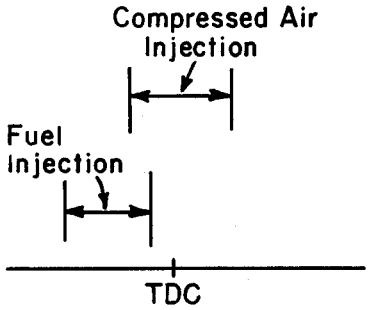
FIG. 5 is a partial chart similar to that in FIG. 4 showing another embodiment of the present invention.

The operation of the present invention, on the other hand is illustrated in FIG. 4 which clearly shows that the fuel is injected first. This has numerous advantages as discussed below. There may be some overlap of the fuel and air injection in the present invention as shown in FIG. 5. However, in all cases according to the present invention, the start of fuel injection precedes the compressed air injection.

The present invention can be applied to an Otto or to a diesel engine. In case of the diesel, the compressed air temperature must be adequate to support burn. Burn occurs as long as air is being injected. This points out a significant advantage over the prior art in that the system of this invention has an extra dimension of control. The standard diesel engine has essentially a fixed amount of air in the cylinder each cycle. The throttle setting determines the amount of fuel injected. The present invention varies both the amount of fuel and air. Thus, the standard diesel has essentially fixed total flow plus a variable air/fuel ratio. The diesel embodiment of this present invention has a variable total charge, plus a variable air/fuel ratio.

Other advantages of this invention are:

1. In the present invention, a large, turbulent mass of air is injected into a small amount of fuel (actually fuel vapor in an exhaust gas base). In contrast, the standard diesel engine finds a small amount of fuel shot into a large amount of air, and turbulence and mixing must be supplied by methods other than that provided by the injected fuel.

2. The chemistry of combustion is more favorable in the present invention with lots of air molecules shot into a fuel atmosphere rather than vice versa. The fuel is much more spread out and combustion loss is always more probable via fuel starvation rather than by oxygen starvation.

3. The remaining exhaust gas is hot and provides good vaporization and homogenuity of the introduced fuel. Any oxygen felt in the exhaust gas in the combustion chamber will immediately be used up.

4. The massive swirling action when the air enters provides what is attempted in the prior art stratified charge concept.

In the Otto cycle embodiment of this invention (1) the fuel is injected, (2) then the air, and (3) then the spark is ignited. Air and/or fuel can be added after ignition, either continually or intermittently, using high pressure, post-ignition injection.

All methods of air injection can be used in this invention (for example, poppet valves, rotary valves, orifice injectors, etc.). One parameter is clear, the start of the compressed air injection must start after the start of the fuel injection.

Figure 6:
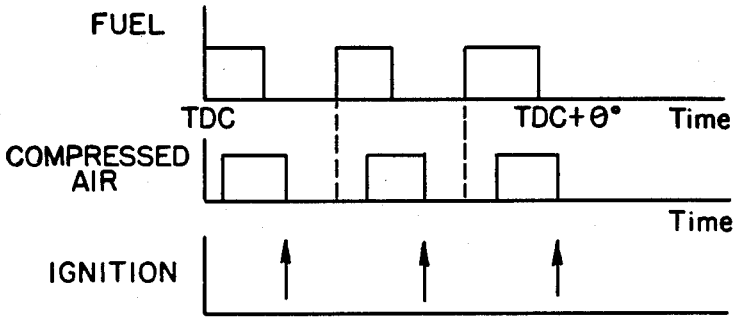
FIG. 6 is a chart showing an intermittant fuel/air feed embodiment of the present invention.

One embodiment includes the use of an interrupted sequence of fuel injection-then air-then fuel-etc. In order to achieve turbulence and stratified charge. This embodiment is illustrated in FIG. 6.

The entire transfer of fuel and air transfer to the combustion chamber takes place during a small range of crank angles preferably near T.D.C. This is in extreme contrast to standard 2-cycle and 4-cycle Otto and diesel engines. For the present invention the fuel is injected prior to air (compressed) injection. There may be overlap when both fuel and air are being injected but the fuel always commences first.

At the time of initiation of fuel injection, only exhaust gases are present, in any amount, in the cylinder and the piston is near top dead center. The hot exhaust gas left in the combustion chamber serves to vaporize the fuel, but no significant chemical reactions will occur because the exhaust gas contains substantially no oxygen (i.e. is oxygen starved). The exhaust gas present at T.D.C. may represent, typically, 10% (by volume) of the fresh fuel to come in. Since the exhaust gas is much hotter than the fuel, the exhaust may be 5–7% by weight of the fuel. If an air/fuel ratio of 15:1 by weight is to be present, then the fuel to exhaust gas ratio is of the order 1:1.5 if the entire amount of fuel for that cycle is injected prior to the air injection. There is little chance for the fuel to condense out in any amount under these conditions.

With a near uniform mixture of hot exhaust gas and fuel vapor in the combustion chamber, the compressed air now is injected into the combustion chamber. The temperature and pressure of the compressed air may be selected such that burning starts immediately upon injection. This situation may be termed a modified diesel cycle; modified in the sense that air is constantly (for a fixed or variable time period that is some selected fraction of the power stroke crank angle) being injected.

The temperature and pressure of the injected air can be selected such that auxiliary methods of ignition are required (such as a spark plug, etc.). In this spark plug embodiment, the engine can be termed a modified Otto cycle; modified in the sense that air is constantly (for a fixed or variable time period that is some fraction of the power stroke crank angle) being injected.

The combustion process can be somewhere inbetween. For example, spark plug ignition can start by having a normal Otto detonation but then a more slow burn can set in as the air injection process continues. The process of: (1) fuel injection, (2) air injection, and (3) ignition can be adjusted around the nominal point of T.D.C. but can also extend on either side thereof. If most of the burn occurs at or very near T.D.C., then an Otto type pressure-volume indicator trace will occur. If significant burn occurs after T.D.C. on the power stroke, then a more constant pressure diesel type pressure-volume indicator trace will occur.

At the end of the power stroke (B.D.C.), the exhaust valve opens up and stays open until near T.D.C. and the cycle then repeats. The differences between this cycle and standard Otto and diesel 2-cycle or 4-cycle engines will be evident to anyone skilled in the art. It is understood that it is necessary that adequate compressed air must be available from some source external to the particular working piston-cylinder unit under consideration.

The present invention can also be used in a modified 4-stroke engine. Consider the end of the power stroke (B.D.C.) as the starting point. The exhaust valves open up and the returning piston drives all but the clearance exhaust gas to the exhaust manifold. At T.D.C. the exhaust valves close and the inlet valves open up and stay open the entire inlet stroke (from T.D.C. to B.D.C.). In a normal 4-cycle (or 4-stroke) engine the inlet valves would now close and compression would take place on the next B.D.C. to T.D.C. stroke. However, in the embodiment of the present invention wherein compressed gas is injected in a 4-stroke engine, the inlet valves stay open for all or most of this "pseudo-compression" phase. Part of the compression can be done externally and the air is partly compressed upon inlet to the cylinder. The inlet valves can be closed at some point in the stroke and thus additional compression can be done if desired (although this is not essential). This action is similar to a standard supercharge process except that the inlet valves are held open during a part or all of the "pseudo-compression" stroke. The advantage of the 4-stroke cycle of the present invention over applicant's modified 2-stroke cycle (see Ser. No. 955,895) is that the valve (inlet) requirements are not so severe. Applicant's 2-stroke cycle requires the inlet valve to be opened and then closed quickly (such as in a high fraction of a millisecond). The 4-stroke cycle finds the inlet valve open for over ½ stroke (several milliseconds). The disadvantage of this 4-stroke cycle is that power is only supplied once every 720° of crank angle versus once every 360° of crank for applicant's 2-stroke cycle.

There are several aspects of this invention to be noted as to both the physical and the chemical nature of the combustion process as contrasted to that of the prior art.

Consider, for example, the situation in the prior art fuel injection process for diesel or gasoline engines. Two chemical reactants are involved. First is the oxygen existing in the gas atmosphere in the cylinder. Second are the hydrocarbon molecules in the fuel stream. The oxygen molecules outnumber the hydrocarbon molecules by about 75:1. The fuel stream, thus, is tiny in comparison to the oxygen gas atmosphere. Turbulence or the like of any size will not be present, and such action (turbulence, etc.) must be supplied elsewhere, for example, by a swirling action set up by a scavenging operation, piston motion, and the like.

The chemistry picture finds a tiny stream of the rare reactant with one droplet (one droplet consists of tens of thousands of molecules) directly behind another droplet. The first entering droplet will naturally leave in its wake an oxygen-starved local atmosphere for the second fuel droplet.

The present case turns the situation around completely (for the better) both physically and chemically. First, the rare reactant is present in the stationary atmosphere as a true vapor with virtually no droplets or condensation possible due to the relatively high temperature. Now the massive stream of the second, plentiful reactant (oxygen containing gas) enters with a relatively great amount of force, velocity, and turbulence (particularly so for applicant's 2-stroke engine).

It is to be understood that more-or-less amounts of exhaust gases can be made to exist in the combustion chamber. More exhaust gas in the charge is obtained merely by closing the exhaust valve further below T.D.C. on the exhaust stroke. Less exhaust in the fresh charge is possible by use of scavenging (i.e. having exhaust and inlet valves open simultaneously for some specified period of time). However, scavenging has disadvantages such as that of lost compressed air to the exhaust manifold.

Figure 7:
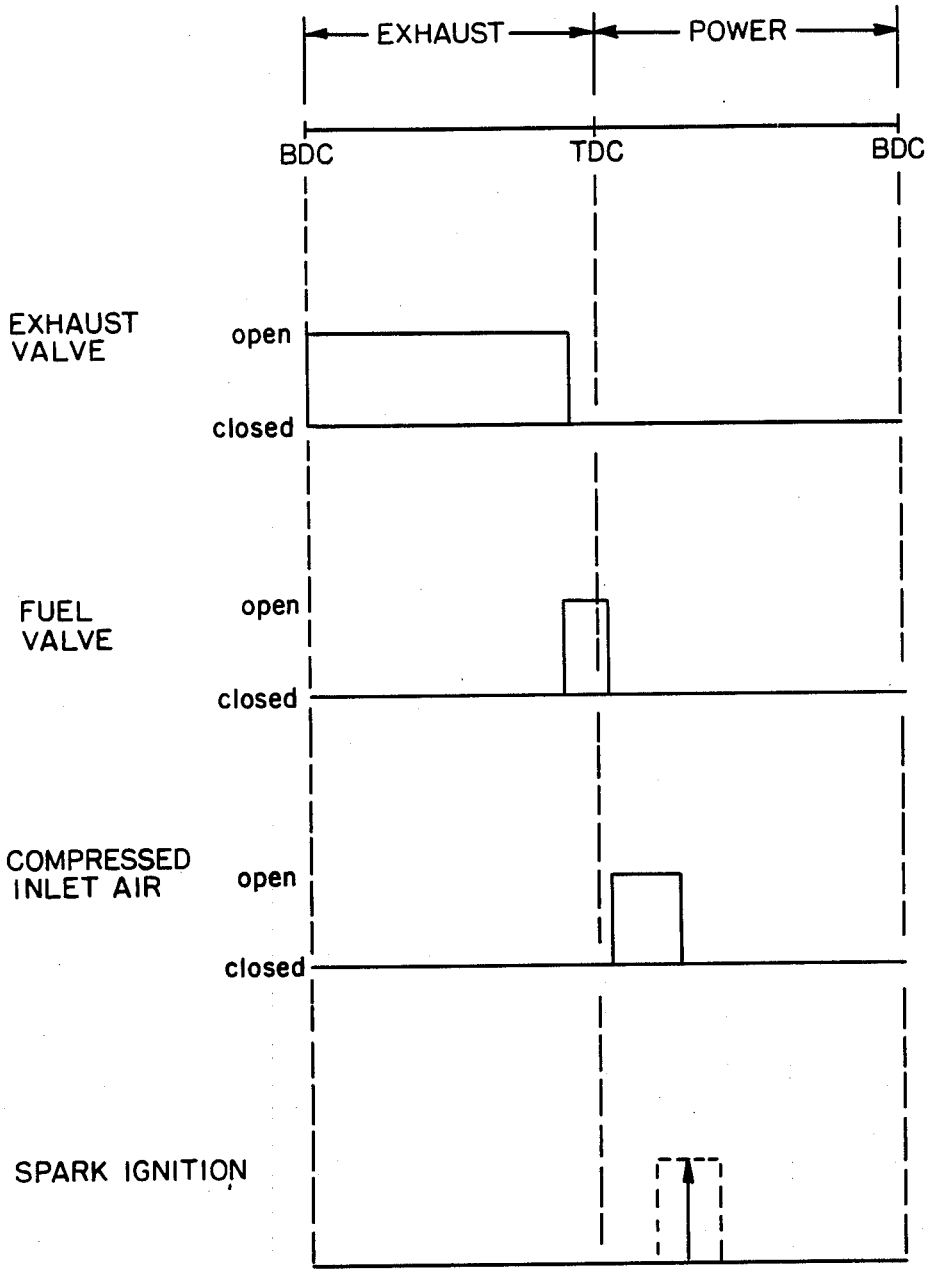
FIG. 7 is another chart showing the operation of a 2-stroke engine of the present invention.

FIG. 7 is a basic timing diagram for applicant's 2-stroke Otto engine in accordance with the present invention. FIG. 7 clearly shows the two strokes of "exhaust" and "power" and also the timing of the opening and closing of the exhaust and compressed air inlet valve and of the fuel valve as well as of spark ignition.

Figure 8:
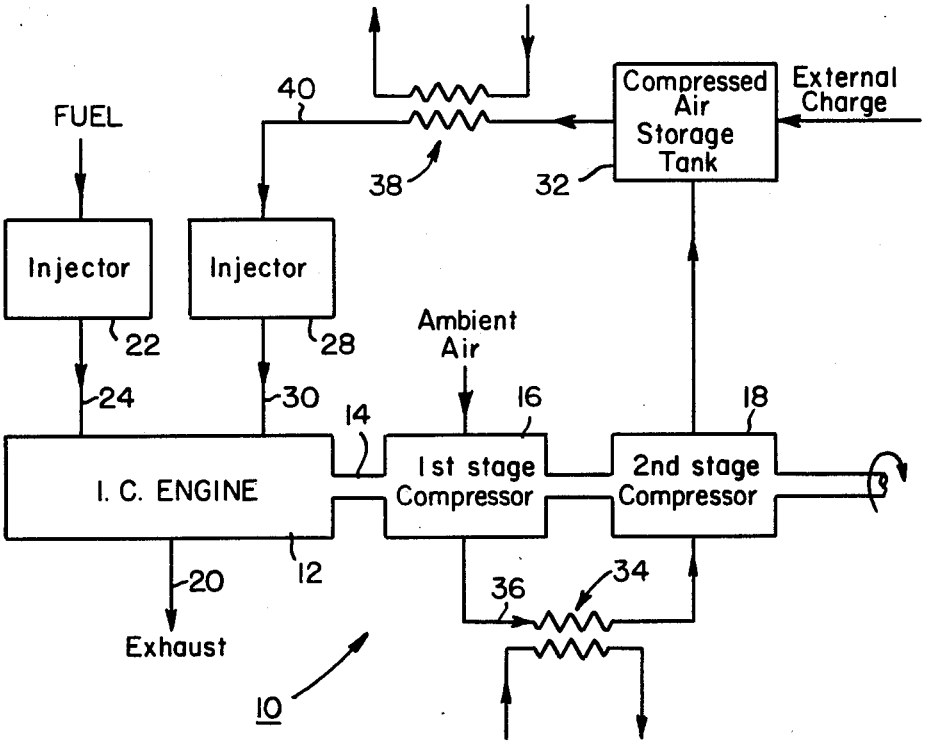
FIG. 8 is a partly diagrammatic, partly schematic view of an engine system according to one embodiment of the present invention.

FIG. 8 is a simplified block diagram of an engine system 10 according to this invention. For simplicity, no provision is shown for starting or electric options or air traction motors although all of these features can be used in combination with this invention. The engine system 10 includes an internal combustion engine 12 (such as a 2 or 4 stroke diesel or gasoline engine) having an output shaft 14 connected to a first stage compressor 16 and a second stage compressor 18. The engine 12 has an exhaust duct 20, a fuel injection system including a fuel injector 22 and fuel line 24 and a compressed air injection system including an injector 28 and a compressed air inlet duct 30. The compressed air to be fed to the engine 12 is provided as follows. Ambient air is compressed by the two-stage compression of compressors 16 and 18 and is then fed to a tank 32 from which it is fed to the injector 28. A first heat exchanger 34 is associated with an air duct 36 between the two compressors 16 and 18 and a second heat exchanger 38 is associated with an air duct 40 feeding compressed air from the tank 32 to the injector 28. The compressors 16 and 18 can be variable rotary vane devices, pistons, screws, lobes, etc. capable of unloading. The compressors can also be tied into the brake systems.

The injectors 22 and 28 can be controlled manually, or semi-automatically as a function of throttle setting, for example. In one embodiment, the injectors are controlled from a microprocessor or other computer. In this case, various sensor data (pressures, temperatures, R.P.M., etc.) is fed to the microprocessor along with data describing the fuel (100 octane, 60 certane, etc.), and the microprocessor automatically adjusts heat transfer in heat exchangers 34 and 38 to assure proper temperatures of the mixtures in the engine to provide knock-free operation and/or minimum pollution ($NO_x$, CO, hydrocarbons, etc.). Typically, the heat exchanger 34 is a cooler in order to minimize overall work of compression. The heat exchanger 38 is generally a heating device and can include an auxiliary burner or preferably utilizes the internal combustion engine exhaust heat to heat the compressed air prior to injection thereof into the internal combustion engine. The heat exchanger 34 can be fed by the internal combustion engine liquid coolant, the slipstream of the vehicle, a fan, etc.

Figure 9:
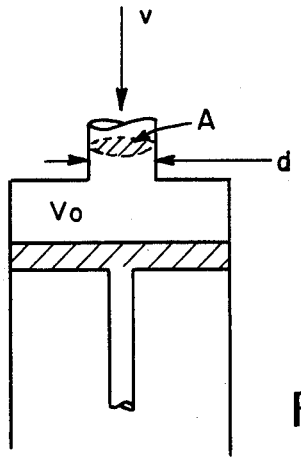
FIG. 9 is a simplified, diagrammatic view of a piston, cylinder, valve arrangement useful with respect to a calculation set forth in the specification.

The air inlet valve for the present invention can be any known type of pertinent valve such as a sleeve valve or a poppet valve. The sleeve valve has large inlet areas useful in this invention. It is useful to calculate the valve inlet equivalent area required for the present case. FIG. 9 shows the basic cylinder, piston, valve geometry. We may write:

$$V = \frac{v_o}{1728} \times \frac{10^3}{\tau} \times \frac{144}{A} \qquad 1.$$

V = Average gas velocity through valve aperture (ft./sec.)

$v$ = Piston-cylinder clearance volume (in.$^3$)

$\tau$ = Valve open time (milliseconds)

A = Valve aperture (in.$^2$)

These are average values and are intended only to supply an order of magnitude check. If the average gas velocity, V, is kept under the speed of sound, then any compression is slight and a near viscous type of flow will occur. This condition can be violated when the air rushes out the instant the valve is opened, but such situation is ignored for the purposes of this calculation. Equation 1 is useful in describing a typical operation. Valve constraints so calculated are likely to be more severe than those in actual practice. If it is insisted that the average gas velocity be less than half the speed of sound, equation 1 becomes $$500 \text{ (ft./sec.)} = \frac{144}{1728} \times 10^3 \frac{v_o}{\tau A} \qquad 2.$$

or $$\frac{v_o}{\tau A} = 6$$

-continued

And $$A = \frac{\pi}{4} d^2 \quad 3.$$

so $$\frac{v_o}{\tau d^2} = 4.71 \quad 4.$$

Figure 10:
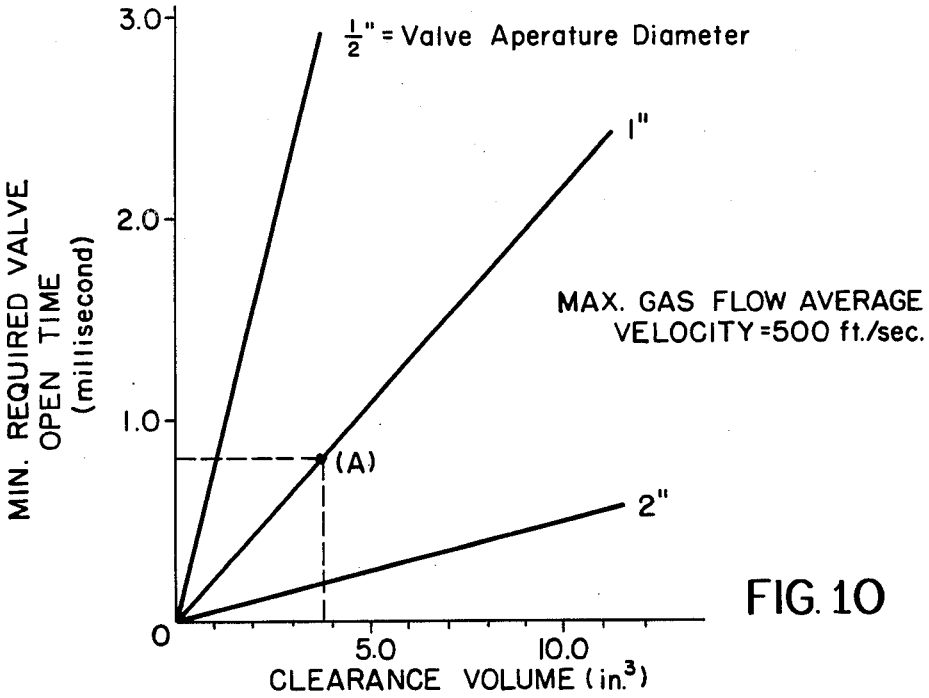
FIG. 10 is a graph of the minimum required valve open time vs. clearance volume, for several valve diameters.

Equation 4 is plotted in FIG. 10 and an example point is shown at "A". If the clearance volume is 4 in.$^3$ and the valve equivalent diameter is 1" then the valve must only be open for just over 0.8 milliseconds in order to perform properly.

Virtually all types of valves (i.e. poppet, rotary, sleeve, slug in cylinder, air operated, electric operated, mechanically (cam) operated, hydraulic operated, etc. can be used). Due to the nature of the geometry, uncovering parts (inlet) with the piston becomes difficult, but is possible. The exhaust valve geometry has similar problems of geometry. Valves can be located in the piston head itself.

There are several interesting tie-ins of the present invention to the stratified charge process:

1. It appears that the present invention may be able to do everything the stratified charge does and more.

2. The present invention appears to compliment and/or supplement the open chamber approach to the stratified charge engine. The Texaco (T.C.P.) Engine described on pages 516–517 of Obert "Internal Combustion Engines" is an example.

3. The present invention appears to compliment and/or supplement the multiple chamber stratified charge engine.

One important aspect of this invention centers around FIGS. 14–23 at page 517of Obert. Here the spark plug is centered at the fuel injection point. The present invention turns things around. The fuel is already in and the air is being injected; this provides a completely different situation.

Applicant's fast air injection 2-stroke diesel engine is a different case yet. It is noted that the language in Obert is such as to make grey the distinction between Otto, diesel, and stratified charge.

Figure 11:
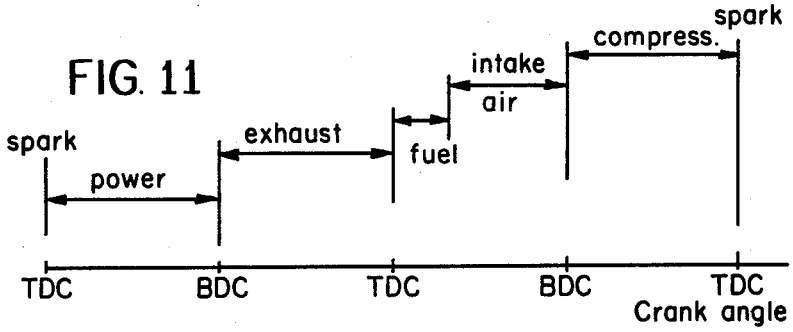
FIG. 11 is a graph showing the operation of a 4-stroke engine according to one embodiment of this invention.

FIG. 11 is a chart showing another embodiment of the present invention. This embodiment includes a 4-stroke internal combustion reciprocating piston engine having power, exhaust, intake and compression strokes as shown in FIG. 11. The intake stroke consists of a first separate fuel intake step followed by a second separate air intake step. In this embodiment the air not previously compressed outside of the engine as in applicant's modified 2-stroke engine (see FIG. 4 above). In this embodiment of FIG. 11, the air and fuel feeding can overlap as shown in FIG. 5. In some cases it can be desired that the air fed in is somewhat compressed with a remaining amount of compression being accomplished in the compression stroke.

Further, while spark ignition is shown, the ignition can alternatively be compression ignition.

Figure 12:
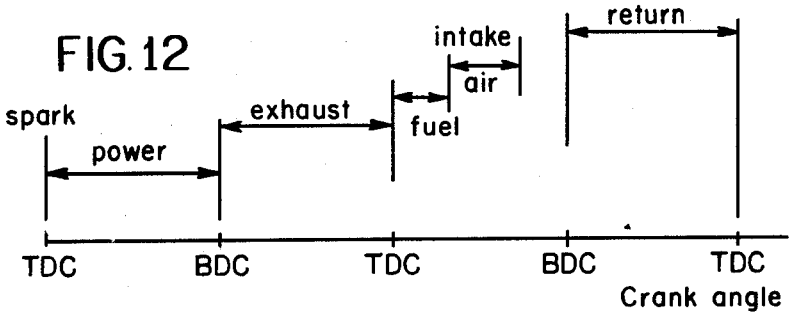
FIG. 12 is a graph showing the operation of a 4-stroke engine according to another embodiment of this invention.

FIG. 12 is a chart showing another embodiment of the present invention. This embodiment includes a 4-stroke engine having power, exhaust, intake and "return" strokes. The air that is fed in is compressed air so that there is no need for a separate compression step (thus the term "return" stroke). During the intake stroke fuel is injected first according to the present invention and then compressed air is injected. The fuel and air steps can overlap as in FIG. 5. The length of the air injection stroke is shown as less then the total length of time (or stroke) available, and it is noted that the time for the air injection can vary from a part to all of the available time, depending for example on the amount of air (and fuel) to be injected in response to demand (the fuel time can also vary).

While spark ignition is shown, compression ignition can also be used, for example, by closing all valves to the combustion chamber toward the end of the return stroke to provide the amount of compression needed for ignition. To prevent unneeded compression from occurring during the return stroke any useful means can be employed such as by having a valve open to the combustion chamber such as the compressed air inlet valve (or a separate, third valve open to a substantially constant pressure tank to prevent fuel from mixing with the compressed air should the compressed air inlet valve be left open).

The term "power stroke" as used in this specification and claims means that portion of the cycle when the piston is moving from T.D.C. to B.D.C. at least part of the time under power of the ignited fuel-air mixture. In certain embodiments, a first portion of this power stroke is used as the fuel and air intake stroke. As stated above, after ignition, more air and/or fuel can be injected as desired, either intermittently or continuously. The present invention provides a swirling action and a stratified charge action as described above.

The invention has been described in detail with particular reference to the preferred embodiments thereof, but it will be understood that variations and modifications can be effected within the spirit and scope of the invention as described hereinabove and as defined in the appended claims.

I claim:

1. A method of feeding air and fuel into the combustion chamber of a reciprocating piston internal combustion engine comprising: feeding fuel into the combustion chamber before the power stroke, and feeding air into said combustion chamber after said fuel feeding step has been initiated.

2. The method according to claim 1 including igniting the fuel/air mixture in said combustion chamber.

3. The method according to claim 1 wherein said air feeding step comprises feeding compressed air into said combustion chamber.

4. The method according to claim 3 including completing said fuel feeding step prior to initiating said air feeding step.

5. The method according to claim 3 including initiating said air feeding step prior to completing said fuel feeding step.

6. The method according to claim 3 including initiating said fuel feeding step at end of an exhaust stroke.

7. The method according to claim 6 including carrying out said fuel feeding step and then said air feeding step during a first portion of the power stroke.

8. The method according to claim 3 including operating said internal combustion engine with a 2-stroke cycle consisting of a power stroke and an exhaust without an intake or compression stroke and carrying out said fuel and air feeding steps during a first portion of said power stroke.

9. The method according to claim 3 including spark igniting the air-fuel mixture in said combustion chamber.

10. The method according to claim 9 including initiating said spark ignition only after said air feeding step has been completed.

11. The method according to claim 9 including initiating said spark ignition during said air feeding step.

12. The method according to claim 8 including compression igniting the air-fuel mixture in said combustion chamber.

13. The method according to claim 3 wherein each of said fuel and air feeding steps comprises a plurality of separate, intermittent, alternating, fuel and air feeding steps prior to each power stroke.

14. The method according to claim 13 including igniting the fuel-air mixture in said combustion chamber at a plurality of separate times corresponding to the plurality of separate, intermittent, alternating fuel and air feeding steps.

15. The method according to claim 3 wherein said air feeding step comprises compressing air and injecting compressed air into said combustion chamber.

16. The method according to claim 15 wherein said air injecting step comprises injecting said air into said combustion chamber in less than a millisecond.

17. The method according to claim 1 including varying both the quantity of fuel and the quantity of air fed into the combustion chamber in response to throttle demand.

18. The method according to claim 17 including compression igniting the fuel-air mixture in the combustion chamber.

19. The method according to claim 2 including feeding in the compressed air so as to provide a swirling action in the combustion chamber.

20. The method according to claim 1 including operating said internal combustion engine with a 4-stroke cycle including power, exhaust, intake, and return strokes and wherein said fuel feeding step comprises feeding fuel into said combustion chamber at approximately the beginning of said intake stroke and said air feeding step comprises feeding air into said combustion chamber after the initiation of said fuel feeding step.

21. The method according to claim 20 wherein said air feeding step comprises feeding compressed air into said combustion chamber.

22. The method according to claim 21 including the step of leaving the combustion chamber open to an atmosphere at a pressure approximately that of the compressed air during said return stroke so that no substantial compression takes place during said return stroke.

23. The method according to claim 22 including spark igniting said fuel-air mixture.

24. The method according to claim 20 wherein said return stroke is a compression stroke and compressing the air-fuel mixture in said combustion chamber during said compression stroke.

25. The method according to claim 24 including spark igniting said fuel-air mixture.

26. The method according to claim 2 including feeding additional quantities of compressed air into said combustion chamber after said ignition step.

27. The method according to claim 2 including feeding additional quantities of fuel into said combustion chamber after said ignition step.

28. The method according to claim 2 including feeding additional quantities of fuel and air into said combustion chamber after said ignition step.

29. An apparatus comprising a reciprocating piston internal combustion engine including at least one cylinder, piston, and combustion chamber therein, means for feeding fuel into said at least one combustion chamber prior to any air being fed into said combustion chamber, and means for feeding air into said combustion chamber after said fuel feeding means has initiated the feeding of fuel into said combustion chamber.

30. The apparatus according to claim 29 including means for igniting the fuel-air mixture in said at least one combustion chamber.

31. The apparatus according to claim 29 wherein said air feeding means comprises means for feeding compressed air into said at least one combustion chamber.

32. The apparatus according to claim 31 wherein said compressed air feeding means includes means for feeding the air such as to cause a swirling action in the combustion chamber.

33. The apparatus according to claim 31 wherein said air feeding means comprises means for initiating the feeding of air into said at least one combustion chamber after all of the fuel has already been fed into said combustion chamber.

34. The apparatus according to claim 31 wherein said air feeding means comprises means for feeding air into at least one combustion chamber while said fuel feeding means is also feeding fuel into said combustion chamber.

35. The apparatus according to claim 31 wherein said fuel feeding means comprises means for feeding fuel into said at least one combustion chamber at the end of each exhaust stroke for said at least one combustion chamber.

36. The apparatus according to claim 29 wherein said fuel and air feeding means comprises means for feeding fuel and air into said at least one combustion chamber during a first portion of a power stroke associated with said at least one combustion chamber.

37. The apparatus according to claim 31 wherein said internal combustion engine is a 2-stroke engine having only a power stroke and an exhaust stroke without a compression stroke and wherein said fuel and air feeding means comprise means for feeding air and fuel into said at least one combustion chamber during a first portion of each power stroke.

38. The apparatus according to claim 37 including means for spark igniting the fuel-air mixture in said at least one combustion chamber.

39. The apparatus according to claim 38 wherein said spark igniting means comprises means for igniting said fuel-air mixture in said at least one combustion chamber after all of the air has been fed into said combustion chamber.

40. The apparatus according to claim 38 wherein said spark igniting means comprises means for spark igniting said air-fuel mixture while air is still being fed into said combustion chamber.

41. The apparatus according to claim 40 including means for injecting additional air into said combustion chamber after ignition.

42. The apparatus according to claim 40 including means for injecting additional fuel into said combustion chamber after ignition.

43. The apparatus according to claim 37 including means for compression igniting said fuel-air mixture.

44. The apparatus according to claim 31 wherein said fuel and air feeding means include means for separately, intermittently, and alternatingly feeding fuel and air into said at least one combustion chamber a plurality of times prior to each power stroke.

45. The apparatus accordng to claim 44 including means for igniting the fuel-air mixture in said combustion chamber a plurality of separate times prior to each power stroke.

46. The apparatus according to claim 31 including means for compressing air and wherein said air feeding means includes means for injecting compressed air into said at least one combustion chamber.

47. The apparatus according to claim 46 wherein said air injecting means comprises means for injecting air into said at least one combustion chamber in less than a millisecond.

48. The apparatus according to claim 29 including means for varying both the quantity of fuel and the quantity of air fed into the combustion chamber in response to throttle demand.

49. The apparatus according to claim 48 including means for compression igniting the fuel-air mixture in the combustion chamber.

50. The apparatus according to claim 29 wherein said internal combustion engine is a 4-stroke engine including power, exhaust, intake and return strokes and wherein said fuel feeding means comprises means for feeding fuel into said combustion chamber at approximately the beginning of said intake stroke and wherein said air feeding means comprises means for feeding air into said combustion chamber after fuel has already been fed into said combustion chamber.

51. The apparatus according to claim 50 wherein said air feeding means comprises means for feeding compressed air into said combustion chamber.

52. The apparatus according to claim 51 including means for holding the air inlet valve open during at least a substantial portion of said return stroke.

53. The apparatus according to claim 51 including means for preventing any substantial amount of compression to take place during said return stroke.

54. The apparatus according to claim 50 wherein said return stroke is a compression stroke and including means for compression the air-fuel mixture during the said compression stroke.

55. The apparatus according to claim 54 including means for spark igniting said fuel-air mixture.

56. The apparatus according to claim 50 including means for spark igniting said fuel-air mixture.

57. The apparatus according to claim 31 including means for feeding additional quantities of compressed air into said combustion chamber after the fuel-air mixture has been ignited.

58. The apparatus according to claim 31 including means for feeding additional quantities of fuel into said combustion chamber after the fuel-air mixture has been ignited.

59. The apparatus according to claim 31 including means for feeding additional quantities of fuel and air into said combustion chamber after the fuel-air mixture has been ignited.

60. Apparatus for feeding air and fuel into each combustion chamber of a reciprocating piston internal combustion engine comprising means for feeding fuel into said combustion chamber prior to any air being fed into said combustion chamber and means for feeding air into said combustion chamber after the feeding of fuel into said combustion chamber has been initiated.

61. The apparatus according to claim 60 including igniting the fuel-air mixture in said combustion chamber.

62. The apparatus according to claim 60 wherein said air feeding means comprises means for injecting compressed air into said combustion chamber.

63. The apparatus according to claim 62 wherein said internal combustion engine is a 2-stroke engine comprising a power stroke and an exhaust stroke without a compression stroke and wherein said means for feeding fuel and air into said combustion chamber comprises means for first injecting said fuel and then said air into said combustion chamber during the first portion of the power stroke.

* * * * *